US007455378B2

(12) United States Patent
Rueby

(10) Patent No.: US 7,455,378 B2
(45) Date of Patent: Nov. 25, 2008

(54) PRINTER CONTROL SYSTEM AND METHOD FOR CHANGING PRINT MASK HEIGHT

(75) Inventor: Christopher Rueby, North Chili, NY (US)

(73) Assignee: Eastman Kodak Company, Rochester, NY (US)

( * ) Notice: Subject to any disclaimer, the term of this patent is extended or adjusted under 35 U.S.C. 154(b) by 132 days.

(21) Appl. No.: 11/385,051

(22) Filed: Mar. 16, 2006

(65) Prior Publication Data

US 2007/0216717 A1 Sep. 20, 2007

(51) Int. Cl.
*B41J 2/205* (2006.01)

(52) U.S. Cl. ..... 347/15

(58) Field of Classification Search ..... 347/15; 358/1.2, 1.9

See application file for complete search history.

(56) References Cited

U.S. PATENT DOCUMENTS

| | | | | |
|---|---|---|---|---|
| 6,226,101 | B1 | 5/2001 | Sato | |
| 6,250,734 | B1 | 6/2001 | Otsuki | |
| 6,336,703 | B1 | 1/2002 | Otsuki | |
| 6,352,326 | B1 | 3/2002 | Maeda | |
| 6,364,451 | B1 | 4/2002 | Silverbrook | |
| 6,454,378 | B1 | 9/2002 | Silverbrook et al. | |
| 6,464,330 | B1 | 10/2002 | Miller et al. | |
| 6,629,744 | B2 | 10/2003 | Otsuki | |
| 6,837,569 | B2 | 1/2005 | Kim | |
| 6,857,725 | B2 | 2/2005 | Otsuki | |
| 6,866,358 | B2 | 3/2005 | Masuyama et al. | |
| 6,906,821 | B1 | 6/2005 | Hanazono et al. | |
| 6,908,168 | B2 | 6/2005 | Kawaguchi | |
| 6,908,242 | B2 | 6/2005 | Oshima et al. | |
| 6,930,696 | B2 | 8/2005 | Otsuki | |
| 6,935,715 | B2 | 8/2005 | Bates et al. | |
| 2002/0175961 | A1 * | 11/2002 | Iwasaki et al. | 347/15 |
| 2003/0035021 | A1 | 2/2003 | Masuyama et al. | |
| 2003/0103101 | A1 | 6/2003 | Otsuki | |
| 2003/0169441 | A1 | 9/2003 | Garcia et al. | |
| 2004/0090477 | A1 | 5/2004 | Faken | |
| 2004/0160470 | A1 | 8/2004 | Billow et al. | |
| 2004/0212658 | A1 | 10/2004 | Otsuki | |
| 2005/0017433 | A1 | 1/2005 | Otsuki et al. | |
| 2005/0024406 | A1 | 2/2005 | Otsuki | |
| 2005/0065867 | A1 | 3/2005 | Aisu et al. | |
| 2005/0083364 | A1 | 4/2005 | Billow | |
| 2005/0146548 | A1 | 7/2005 | de Pena et al. | |
| 2005/0156960 | A1 | 7/2005 | Courian et al. | |

FOREIGN PATENT DOCUMENTS

| | | |
|---|---|---|
| EP | 1072421 | 1/2001 |

* cited by examiner

*Primary Examiner*—Matthew Luu
*Assistant Examiner*—Justin Seo
(74) *Attorney, Agent, or Firm*—Donna P. Suchy

(57) ABSTRACT

A system and a method for improving the quality of prints using a print mask for a printer with at least one printhead with a plurality of dot forming elements arranged in dot forming element sections, and at least one of the masks are altered so that mask data corresponding to at least one complementary set of dot forming elements is activated or deactivated in response to the paper location and the dot forming element section is shifted as the printhead passes a transition position. As the mask size is reduced, for example, the mask contents are shifted to one end of the printhead. This remapping of the mask within the head allows the page advance distance to be changed to the new page advance distance only once.

15 Claims, 15 Drawing Sheets

PASS 4: PRINT HEAD/MASK:

OUTPUT PRINT:

INPUT IMAGE:

| | | | | | | | | | |
|---|---|---|---|---|---|---|---|---|---|
| 1 | 1 | 1 | 1 | 0 | X | X | X | X | |
| 1 | 0 | 0 | 1 | 1 | x | | | x | |
| 1 | 0 | 0 | 0 | 0 | X | | | | |
| 1 | 0 | 0 | 0 | 0 | X | | | | |
| 1 | 0 | 0 | 1 | 0 | | | | | |
| 1 | 1 | 1 | 1 | 1 | x | x | x | x | |
| 0 | 0 | 0 | 0 | 0 | | | | | |
| 1 | 0 | 1 | 0 | 0 | | | | | |
| 0 | 1 | 0 | 0 | 0 | | | | | |
| | | | | 1 | | | | | |
| | | | | 0 | | | | | |
| | | | | 0 | | | | | |

PAGE ADVANCE DIRECTION

FIG. 5d

PASS 5: PRINT HEAD/MASK:

INPUT IMAGE:

| | | | |
|---|---|---|---|
| 1 | 1 | 1 | 1 |
| 1 | 0 | 0 | 1 |
| 1 | 0 | 0 | 0 |
| 1 | 0 | 0 | 0 |
| 1 | 0 | 0 | 1 |
| 1 | 1 | 1 | 1 |
| 0 | 0 | 0 | 0 |
| 1 | 0 | 1 | 0 |
| 0 | 1 | 0 | 0 |

| |
|---|
| 0 |
| 1 |
| 0 |
| 0 |
| 0 |
| 1 |
| 0 |
| 0 |
| 0 |
| 1 |
| 0 |
| 0 |

OUTPUT PRINT:

| | | | |
|---|---|---|---|
| X | X | X | X |
| X | | | X |
| X | | | |
| X | | | |
| x | | | x |
| X | X | X | X |
| | | | |
| | | | |
| | x | | |

PAGE ADVANCE DIRECTION

FIG. 5e

PASS 6: PRINT HEAD/MASK:

INPUT IMAGE:

| | | | |
|---|---|---|---|
| 1 | 1 | 1 | 1 |
| 1 | 0 | 0 | 1 |
| 1 | 0 | 0 | 0 |
| 1 | 0 | 0 | 0 |
| 1 | 0 | 0 | 1 |
| 1 | 1 | 1 | 1 |
| 0 | 0 | 0 | 0 |
| 1 | 0 | 1 | 0 |
| 0 | 1 | 0 | 0 |

| |
|---|
| 0 |
| 1 |
| 0 |
| 0 |
| 0 |
| 1 |
| 0 |
| 0 |
| 0 |
| 1 |
| 0 |
| 0 |

OUTPUT PRINT:

| | | | |
|---|---|---|---|
| X | X | X | X |
| X | | | X |
| X | | | |
| X | | | |
| X | | | X |
| X | X | X | X |
| | | | |
| x | | x | |
| | X | | |

PAGE ADVANCE DIRECTION

*FIG. 5f*

PRINT MODE CHANGE EXAMPLE -
4 PASS 1/3 TO 2/3 HEAD TO FULL HEAD AT START OF PRINT

PRINT MODE MORPHING EXAMPLE -
4 PASS FULL TO 2/3 HEAD AT END OF PRINT

PRINTER CONTROL SYSTEM AND METHOD FOR CHANGING PRINT MASK HEIGHT

FIELD OF THE INVENTION

The invention relates generally to the field of swath-type printing, such as inkjet printing, and more particularly to a print mask method and controller to alter selection of inkjet nozzles as the printhead approaches a paper position such as a transition position thus solving the problem of printed image artifacts due to paper curl and partial print head usage.

BACKGROUND OF THE INVENTION

Inkjet printing is a non-impact method for producing images by the deposition of ink droplets in a pixel-by-pixel manner onto an image-recording element in response to digital signals. There are various methods that may be utilized to control the deposition of ink droplets on the receiver member to yield the desired image. In one process, known as drop-on-demand inkjet printing, individual droplets are ejected as needed onto the recording medium to form the desired image. Common methods of controlling the ejection of ink droplets in drop-on-demand printing include piezoelectric transducers and thermal bubble formation using heated actuators. With regard to heated actuators, a heater placed at a convenient location within the nozzle or at the nozzle opening heats ink in the nozzle to form a vapor bubble that causes a drop to be ejected to the recording medium in accordance with image data. With respect to piezoelectric actuators, piezoelectric material is used in conjunction with each nozzle and this material possesses the property such that an electrical field when applied thereto induces mechanical stresses therein causing a drop to be selectively ejected from the nozzle selected for actuation. The image data provides signals to the printhead determining which of the nozzles are to be selected for ejecting an ink drop, such that each nozzle ejects an ink drop at a specific pixel location on a receiver sheet.

In another process, known as continuous inkjet printing, a continuous stream of droplets is discharged from each nozzle and deflected in an image-wise controlled manner onto respective pixel locations on the surface of the recording member, while some droplets are selectively caught and prevented from reaching the recording member. Inkjet printers have found broad applications across markets ranging from the desktop document and pictorial imaging to short run printing and industrial labeling.

A typical inkjet printer produces an image by ejecting small drops of ink from the printhead containing spatial array nozzles, and the ink drops land on a receiver medium (typically paper, coated paper, etc. and referred to generically here as paper or page or media) at selected pixel locations to form round ink dots. Normally, the drops are deposited with their respective dot centers determined by a rectilinear grid, i.e. a raster, with equal spacing in the horizontal and vertical directions. The inkjet printers may have the capability to either produce dots of the same size or of variable size. Inkjet printers with the latter capability are referred to as multitone or gray scale inkjet printers because they can produce multiple density tones at each selected pixel location on the page.

Inkjet printers may also be distinguished as being either pagewidth printers or swath printers. Examples of pagewidth printers are described in U.S. Pat. Nos. 6,364,451 B1 and 6,454,378 B1. As noted in these patents, the term "pagewidth printhead" refers to a printhead having a printing zone that prints one line at a time on a page, the line being parallel either to a longer edge or a shorter edge of the page. The line is printed as a whole as the page moves past the printhead and the printhead is typically stationary, i.e. it does not transverse the page. These printheads are characterized by having a very large number of nozzles. The referenced U.S. patents disclose that should any of the nozzles of one printhead be defective the printer may include a second printhead that is provided so that selected nozzles of the second printhead substitute for defective nozzles of the primary printhead.

A swath printer uses a printhead having a plurality of nozzles disposed in an array in one or more rows, such that the length of the array is somewhat less than the height of the page. The multiple rows can be nozzles for ejecting different ink colors or different droplet sizes. Multiple rows are also used to increase the effective nozzle density for printing by staggering the rows of nozzles along the length of the array. Because the array length is less than the height of a page, printing is done in swaths having a height, which is equal to or less than the array length. A swath is printed as the printhead traverses across a page to be printed in a traversal direction, which is substantially perpendicular to the array length. The printhead traversal direction is also referred to as the fast scan direction. After the swath is completed, the paper is advanced along a paper movement axis, which is perpendicular to the printhead traversal direction. The paper movement axis is also called the slow scan direction. The distance of paper advance is set to be less than or equal to the swath height in order to allow every pixel location on the page to be printed in successive swaths. For fastest printing throughput, all pixels to be printed in the region traversed by the printhead are printed during a single pass, and the page advance is set to the swath height. However, in many applications it is found that print quality is improved if a subset of pixels is printed in each pass, and multiple passes are used to print each region. In multi-pass printing, the page advance distance is set to be less than the swath height.

There are many techniques present in the prior art that describe methods of controlling the printer including "print masking." The term "print masking" generally refers to printing subsets of the image pixels in multiple passes of the printhead relative to a receiver medium. The print mask indicates which pixels have permission to be printed during a given pass of the printhead.

When printing on a cut-sheet inkjet printer, the paper is held by (at least) two sets of rollers. The first set is made up of a long main roller below the paper and one or more rollers above. The upper rollers are tensioned against the lower roller and are free turning. The lower roller is driven to advance the paper. The second set of rollers has a long main roller below the paper and one or more star wheels above the paper. The star wheels are tensioned against the lower roller and are free turning. The second upper set are star shaped to minimize contact with the freshly printed paper surface and to avoid smearing the ink.

As the paper is fed through the printer, it starts out held by only the first roller set. In this portion of the printing process, the paper may curl up or down, changing the head/paper spacing which changes dot alignment. Part way into the print, the paper will start being held by the star wheel rollers also. This middle area of the print is the most stable for paper advance and head/paper spacing since the paper is held by both sets of rollers. Then, at the end of the print, the paper comes out of the first roller and is only held by the star wheel rollers. At this point, paper curl could change the head/paper spacing. Also, the paper advance distances may not be as accurate when the paper is only held by the star wheel rollers.

One method of solving this in the past was by changing to different print modes at the leading and/or trailing edges of the print. A print mode is defined as the combination of the print mask size, print mask data, and page advance distance. One problem with this approach is that it requires the paper to be advanced in a short/long/short/etc sequence when weaving the end of one print mode into the next print mode. Changing paper advance distances up and down can introduce feed errors. Also, the number of nozzles printing from one pass to the next varies significantly and down by a large percentage of the printhead. This can cause electrical current and thermal effects in the printhead.

SUMMARY OF THE INVENTION

In accordance with an object of the invention, both a system and a method are provided for improving the quality of prints using a print mask for a printer with a multi-pass print mode including at least one printhead with a plurality of dot forming elements arranged in sections and a paper location that includes at least one transition position along a paper path with at least one mask, each mask providing a dot forming element pattern responsive to image data representing the image and to paper location and at least one of the masks is altered so that mask data corresponding to at least one complementary set of dot forming elements is activated or deactivated in response to the paper location and the section is shifted along a paper movement axis as the print head passes the transition position.

In order to reduce print artifacts at the leading and/or trailing edge print areas, the print mask used in the main body of the print can be reduced in size and shifted to the end of the print head that is closest to the roller holding the paper. With the appropriate reduction of the mask and shift distance, it is possible to go directly from one paper advance distance to the next, and stay at the new paper advance distance until the next mode change point. This will reduce the paper feed errors introduced in the previous mechanisms. Also, this type of mode changing will gradually change the height of the printhead used, reducing the electrical current and thermal effects on the printhead. By subsampling the main body print mask for use at the edge areas rather than using a separate print mask for each region, memory and storage usage is reduced. Also, since the entire image is printed with the same dither pattern and duty cycle profile, a more uniform appearance is maintained in the print.

Another benefit of this mechanism is that the print mask height can be adjusted to help compensate for failed dot forming elements. By changing the print mask height slightly, the pattern of complementary dot forming elements can be changed. This can be used to work around cases where multiple complementary dot forming elements have failed and there are not enough dot forming elements in a set to print the required number of dots.

This mechanism will work on print masks with any number of passes, as long as the page advance distance is constant for the entire base mask. This mechanism may be applied multiple times at one or both edges of a print, gradually increasing or decreasing the size of the print mask as needed.

While the specification concludes with claims particularly pointing out and distinctly claiming the subject matter of the present invention, it is believed the invention will be better understood from the following detailed description when taken in conjunction with the accompanying drawings.

BRIEF DESCRIPTION OF THE DRAWINGS

FIG. 5*a*-5*f* illustrates a sequence of printing using the exemplary mask shown in FIG. 4.

DETAILED DESCRIPTION OF THE INVENTION

The present description will be directed in particular to elements forming part of, or cooperating more directly with, apparatus and methods in accordance with the present invention. It is to be understood that elements not specifically shown or described may take various forms well known to those skilled in the art.

In the specification, various terms are employed and are defined as discussed above and summarized below as follows:

The term "print mask " is related to the controls that are used to give permission to print, referring to the dot forming elements, including nozzles, and including an image-independent matrix determining which printing element (nozzle) should be used for each potential dot location on a receiver. A print mask can be used for multi-pass, multi-drop and multi-channel (which includes color or other printable materials) situations.

The term "dot forming elements" refers to any of the myriad of ways, including the nozzles of an inkjet printer, that a dot may be formed on a recording medium.

The term "print mode" refers to the set of instructions relative to one mask matrix (width×height), the number of passes, and the maximum number of drops per pixel. If any of these parameters change then it is a mode change.

For one of the contiguous sections of nozzles that compose the mask (see the following descriptions and associated drawings), the height of the mask section is determined by taking the total mask height (in number of nozzles) and dividing by total number of passes for that particular mode $$\therefore \text{section height size} = \text{mask height} / \text{\# passes}$$

The term "complementary nozzles" refers to a set of nozzles, one from each mask section, each of which will have the capability of printing pixels on the same line of the output print as the media is advanced for each successive print swath. Complementary nozzles line up with each other on any given line of the printed output as is illustrated below in FIG. 3 where there are three sets of complementary nozzles:

Set 1: Mask positions A1, B1, C1, D1 [those for the first line to be printed]

Set 2: Mask positions A2, B2, C2, D2 [those for the second line to be printed]

Set 3: Mask positions A3, B3, C3, D3 [those for the third line to be printed]

The term "printhead size" refers to the number of nozzles contained in the printhead. This term usually refers to the number of nozzles capable of printing one color and is generally configured in a linear or rectangular formation such as that necessary to define 1-2 columns of nozzles.

Figure 1:
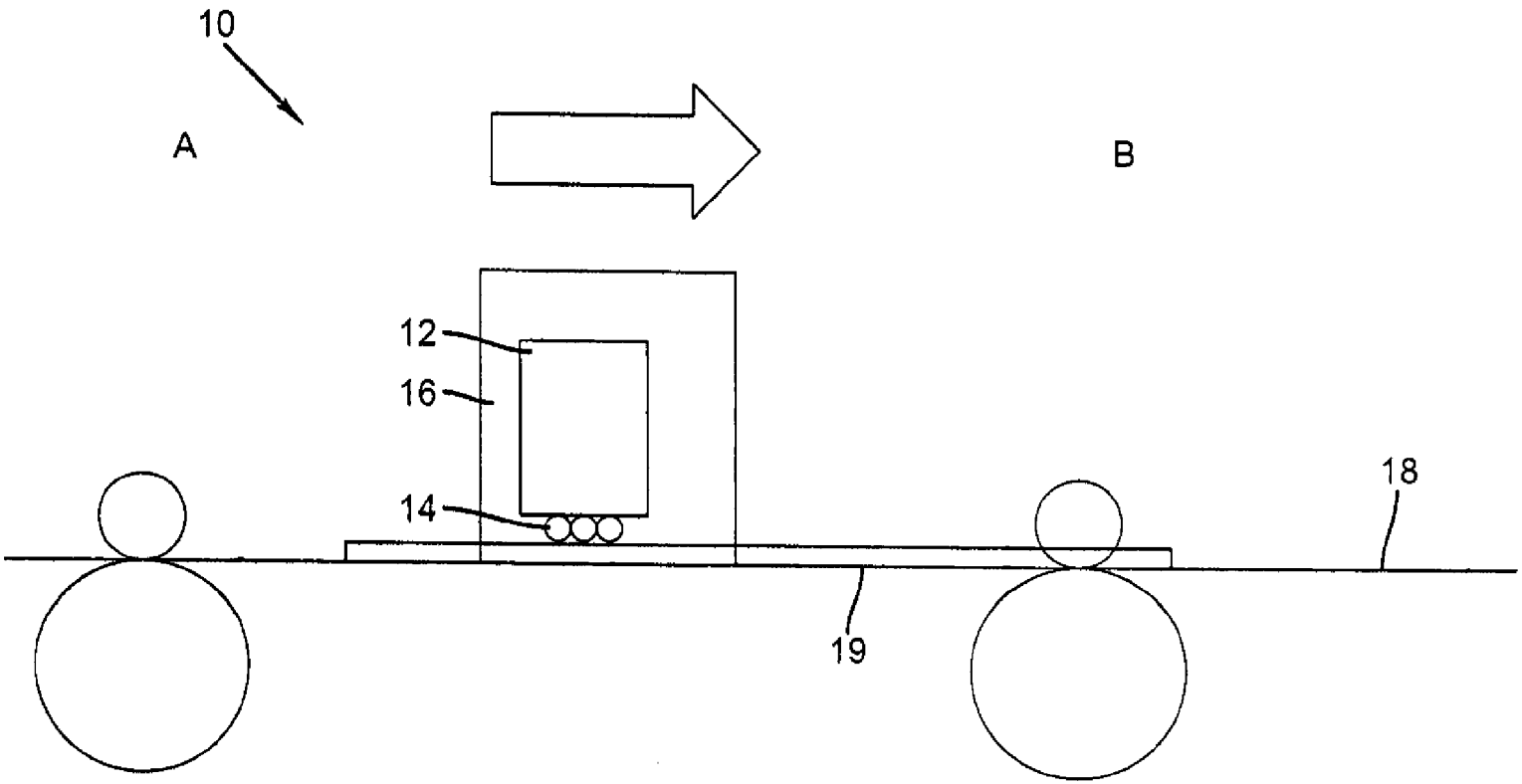
FIG. 1 shows an inkjet printer with a printhead supporting a plurality of dot forming elements.

FIG. 1, shows a printer 10 which incorporates a printing system in accordance with the methods and systems described below and with reference to commonly assigned U.S. Pat. No. 6,464,330 B1 filed in the names of Miller et al. An inkjet printhead 12 including dot forming elements that include devices such as nozzles 14 mounted on carriage 16 facing the recording medium, and also referred to generically as a page, paper, media, or receiver 18. Carriage 16 is coupled through a timing belt and a driver motor (not shown) so as to be reproducibly movable back and forth in a direction perpendicular to the movement of the recording medium 18 shown by arrows A-B). It will be understood that for a printer having multiple different color inks that there may be multiple printheads similar to that described for printhead 12. The different color printheads are arranged on a carriage 16 that traverses across the receiver sheet for a print pass. The nozzles 14 in each of the color printheads, are actuated to print with ink in their respective colors in accordance with image instructions received from a controller or image processor using the various print masks described below.

As the paper moves through the printer, it moves through different regions which are separated from each other by one or more transition positions 19. As described previously, near the leading edge the paper is held only by the first roller set (not shown), and paper curl may change head/paper spacing in this region. Part way into the print, the paper will start being held by both sets of rollers (not shown), so that in this middle region the head/paper spacing and paper advance accuracy are both well controlled. Toward the trailing edge, the paper is held only by the second set of the rollers, and again the head/paper spacing and paper advance accuracy are less well controlled. One or more transition positions 19 may be defined, for example, between the leading edge and the middle region, and also between the middle region and the trailing edge.

Figure 2:
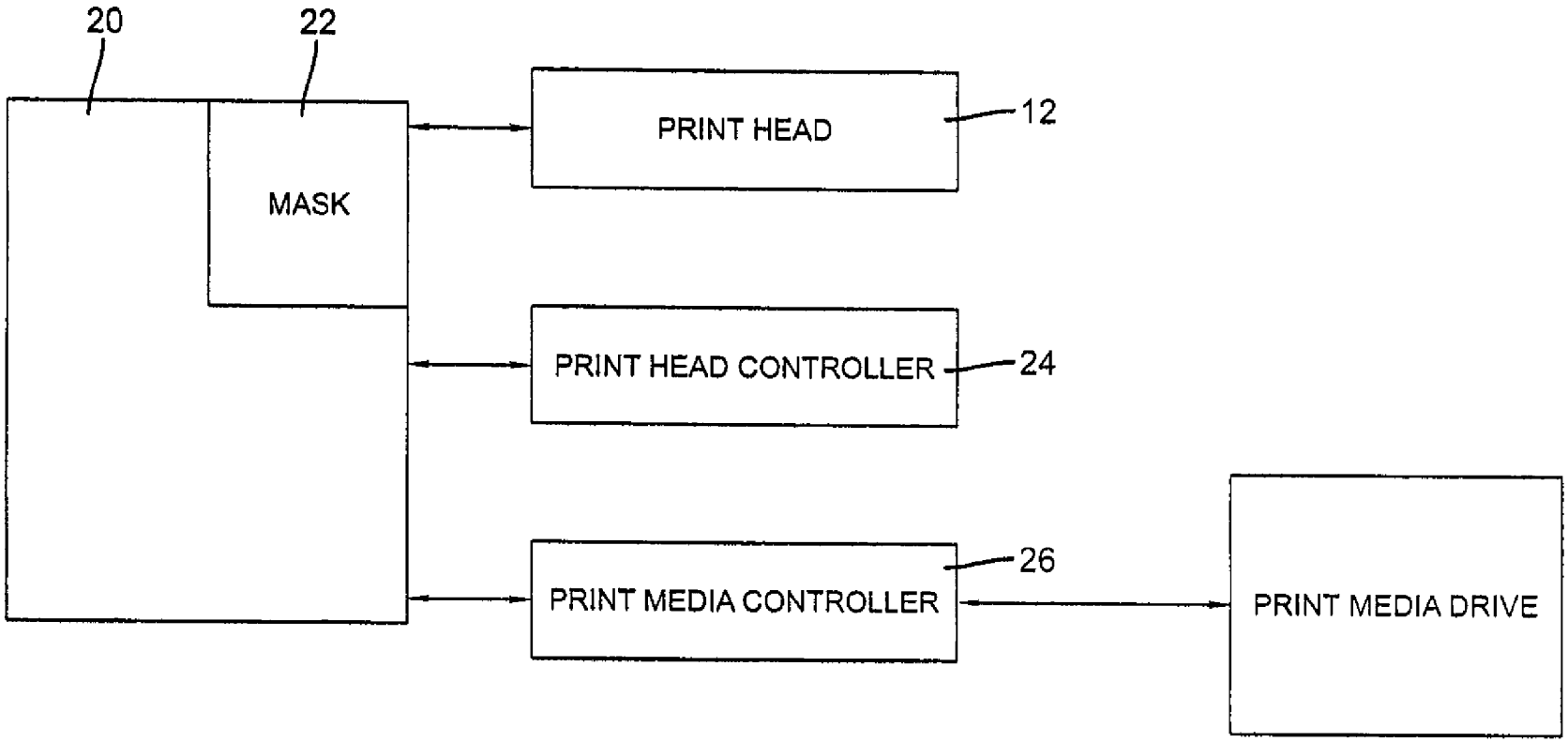
FIG. 2 is a flowchart illustrating the control features on an inkjet printer.

FIG. 2 shows a schematic of a printhead controller that uses a print mask to control nozzle operations. The inkjet printer shown has a controller 20 that controls a printhead 12 including a print mask 22. It also includes a printhead controller and driver 24 and a print media controller and driver 26. The controller 20, which may include one or more micro-computers is suitably programmed to provide signals to the printhead controller and driver 24 that directs the printhead carriage drive to move the printhead. While the printhead is moving, the controller uses the print mask 22 to direct the printhead to eject ink drops onto the receiver medium 18 at appropriate pixel locations of a raster. Pixels on the raster are being selectively printed in accordance with image signals representing print or no print decisions for each pixel location and/or pixel density gradient or drop size for each pixel location. The controller 20 may include a raster image processor, which controls image manipulation of an image file, which may be delivered to the printer; via a remotely located computer through a communication port. Memory in the printer may be used to store the image file while the printer is in operation. Thus as noted above the printer may include a number of printheads, each for a different color. Preferably the printer includes enough printheads to print three or more different color inks.

The bitwise print mask 22 contains a row of boolean data per nozzle in the printhead 12. The height H of the mask is less than or equal to the number of nozzles 14 in the printhead. The value in each position of the mask is logically ANDed with the image data to determine whether to eject a drop at each location. Each mask row may contain 1 or more columns C. If the mask is narrower than the width of the image being printed, the mask is tiled across the image. The mask is divided into N sections, where N is the number of print passes to be performed on the image, and N is at least 1. The height of each section SH is the same, calculated as SH=H/N. The value of H must be picked such that SH is a whole integer number. The value SH is also the number of lines that the page is advanced after each carriage pass or swath. The corresponding nozzles within each mask section are known as complementary nozzles. The complementary nozzles are the ones that print a single row of the image as the page is advanced.

Below is a diagram showing the structure of a simple 4-pass print mask. In this example H=12, N=4, SH=3, C=1. In this and subsequent examples, the printhead is assumed to have 12 nozzles. For typical printers, the actual number of nozzles is usually several hundred or more, and the mask height H will also be correspondingly much greater than 12. Dotted lines in the diagram represent the boundaries between mask sections.

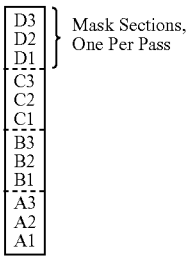

A section letter and a number (i.e. the mask layout identifiers) denote the positions in the mask. The data values at each position can be either a 0 or 1. In this example, there are three sets of complementary nozzles:

Set 1: Mask positions A1, B1, C1, D1

Set 2: Mask positions A2, B2, C2, D2

Set 3: Mask positions A3, B3, C3, D3

Here the complementary nozzles are the ones that will fall on the same line of the output print when the media is advanced for each successive swath. The print mask is mapped onto the printhead as shown in the next diagram. Note that the printhead may have more nozzles than the print mask has entries.

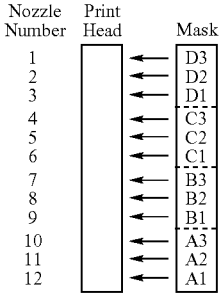

For example, the following is a 4-pass print mask that can lay down 1 drop per pixel:

| |
|---|
| 0 |
| 1 |
| 0 |
| 0 |
| 0 |
| 1 |
| 0 |
| 0 |
| 0 |
| 1 |
| 0 |
| 0 |

It would map onto the print head as follows:

| Nozzle Number | Print Head | Mask Layout | Mask Data |
|---|---|---|---|
| 1 | 0 | D3 | 0 |
| 2 | 1 | D2 | 1 |
| 3 | 0 | D1 | 0 |
| 4 | 0 | C3 | 0 |
| 5 | 0 | C2 | 0 |
| 6 | 1 | C1 | 1 |
| 7 | 0 | B3 | 0 |
| 8 | 0 | B2 | 0 |
| 9 | 0 | B1 | 0 |
| 10 | 1 | A3 | 1 |
| 11 | 0 | A2 | 0 |
| 12 | 0 | A1 | 0 |

Figure 3:
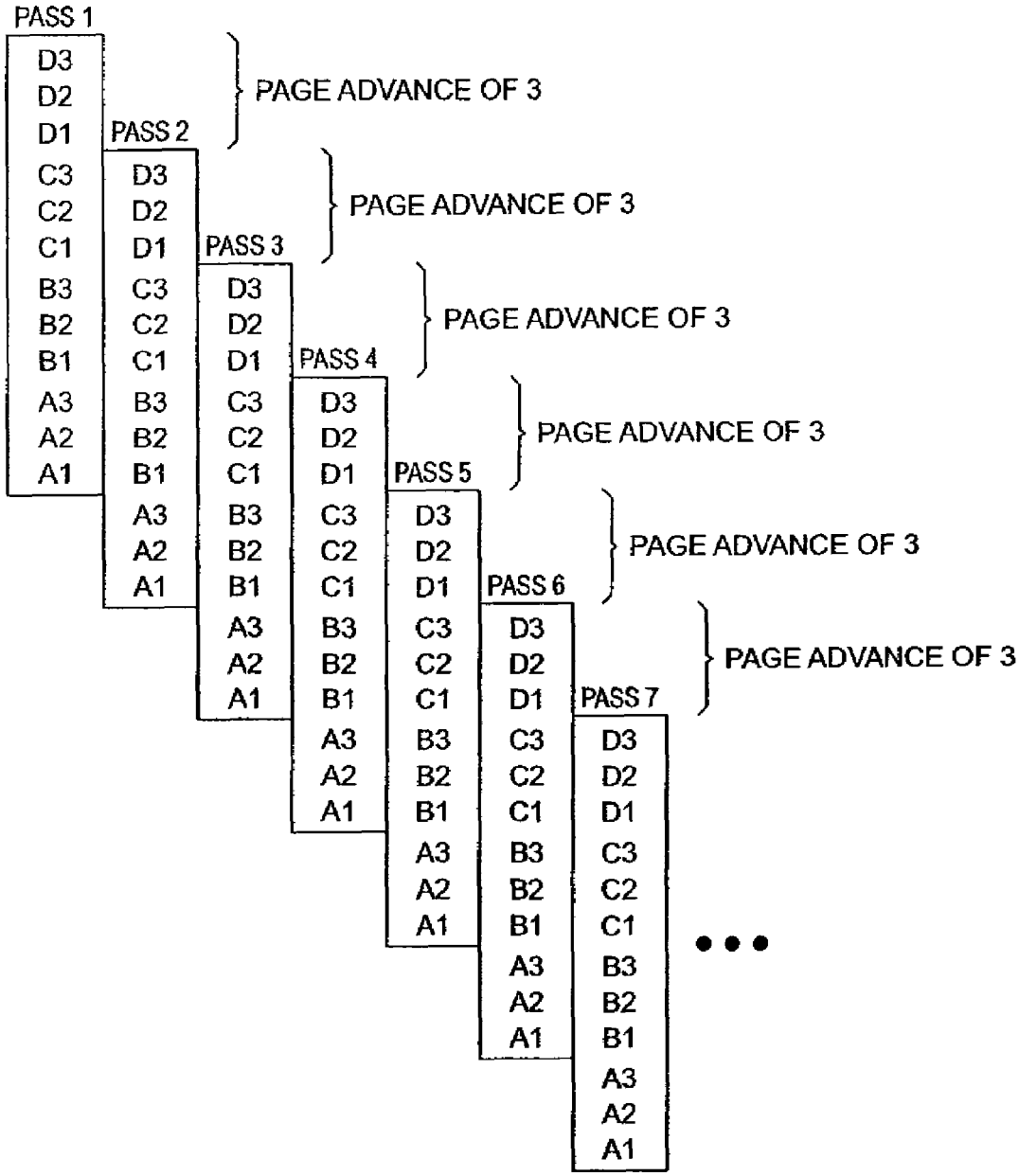
FIG. 3 illustrates an exemplary mask.

As shown in FIG. 3, the printhead 12 is advanced relative to the page 18 at the end of each swath. Actually it is the paper that is being moved, but for simplicity of representation, the figures are drawn as if the printhead is moving in the opposite direction than the paper is actually being moved. This example shows a 4-pass 12-nozzle mask. The mask layout identifiers are shown in the printhead. Note in the figure that the mask is shown as moving with the printhead. In other words, in FIG. 3, mask position A1 is always associated with nozzle 12, A2 is always associated with nozzle 11, etc. This is the case for normal multi-pass printing. This diagram shows how the printhead moves in relation to the page from swath to swath for purposes of illustration, but does not imply that the printhead is moving in that direction. In this figure it can be seen how the complementary nozzles line up with each other on any given line of the output.

Figure 4:
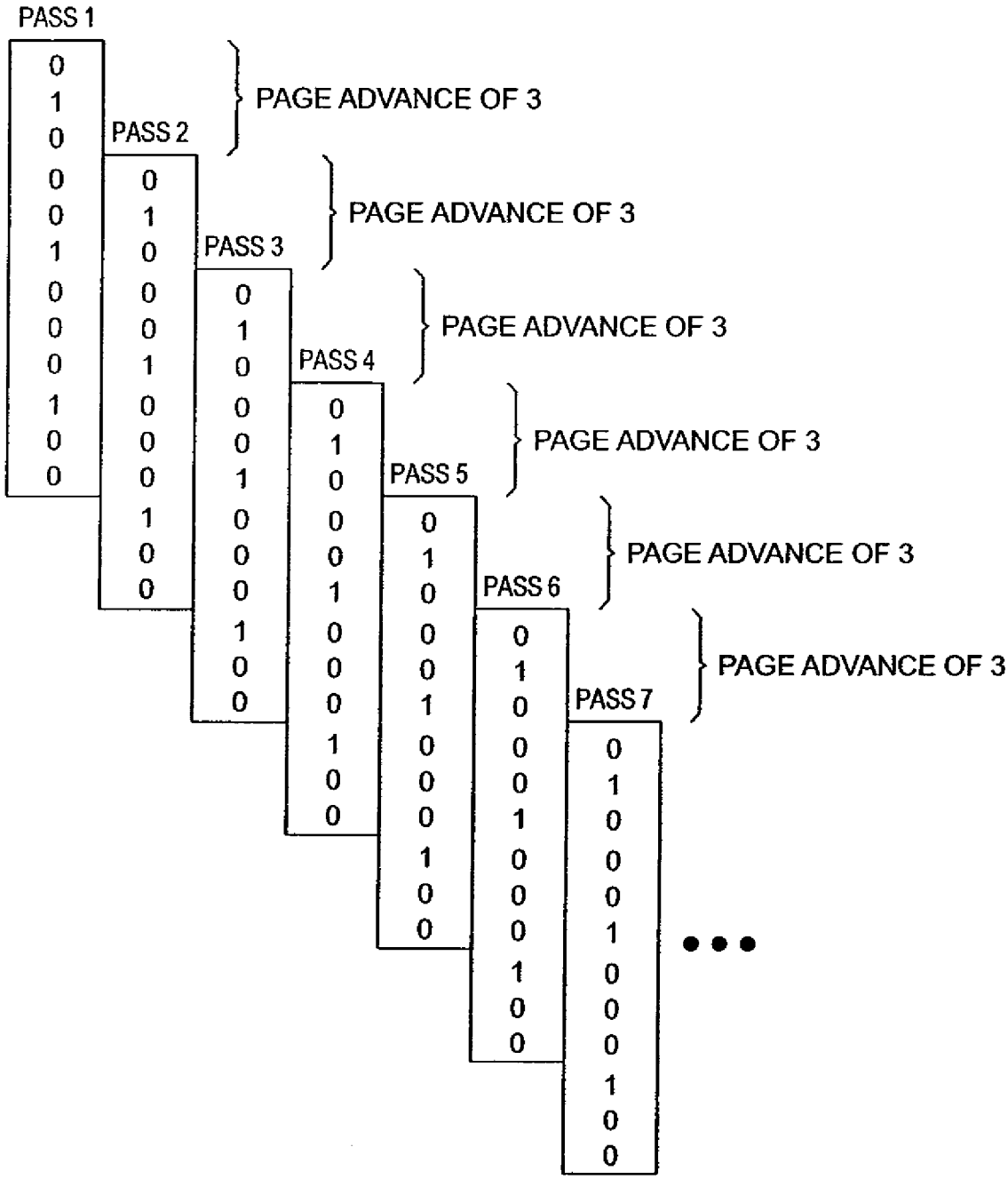
FIG. 4 illustrates a 4-pass mask that will print at most one dot per pixel mask.
Figure 5A:
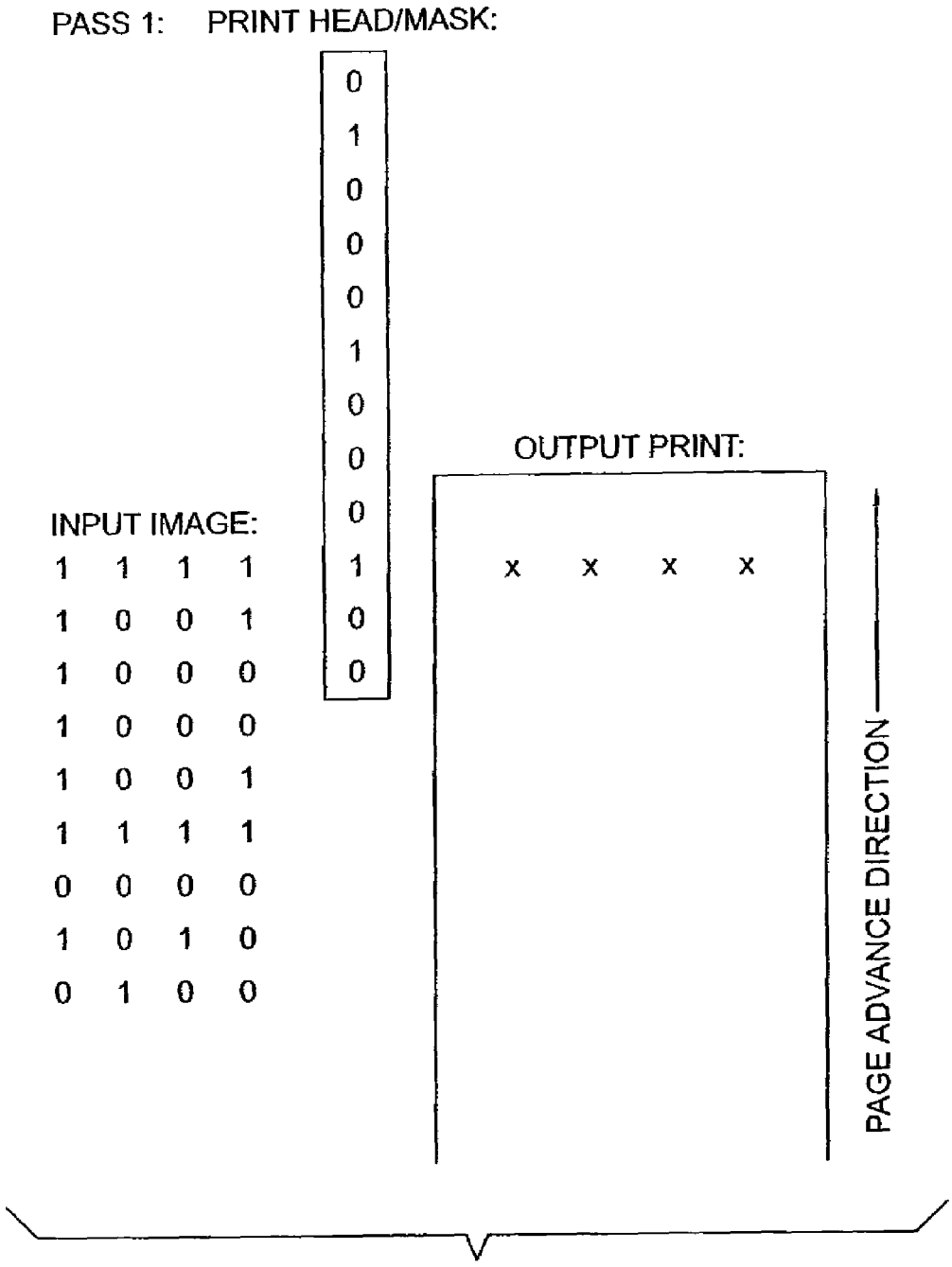
Figure 5B:
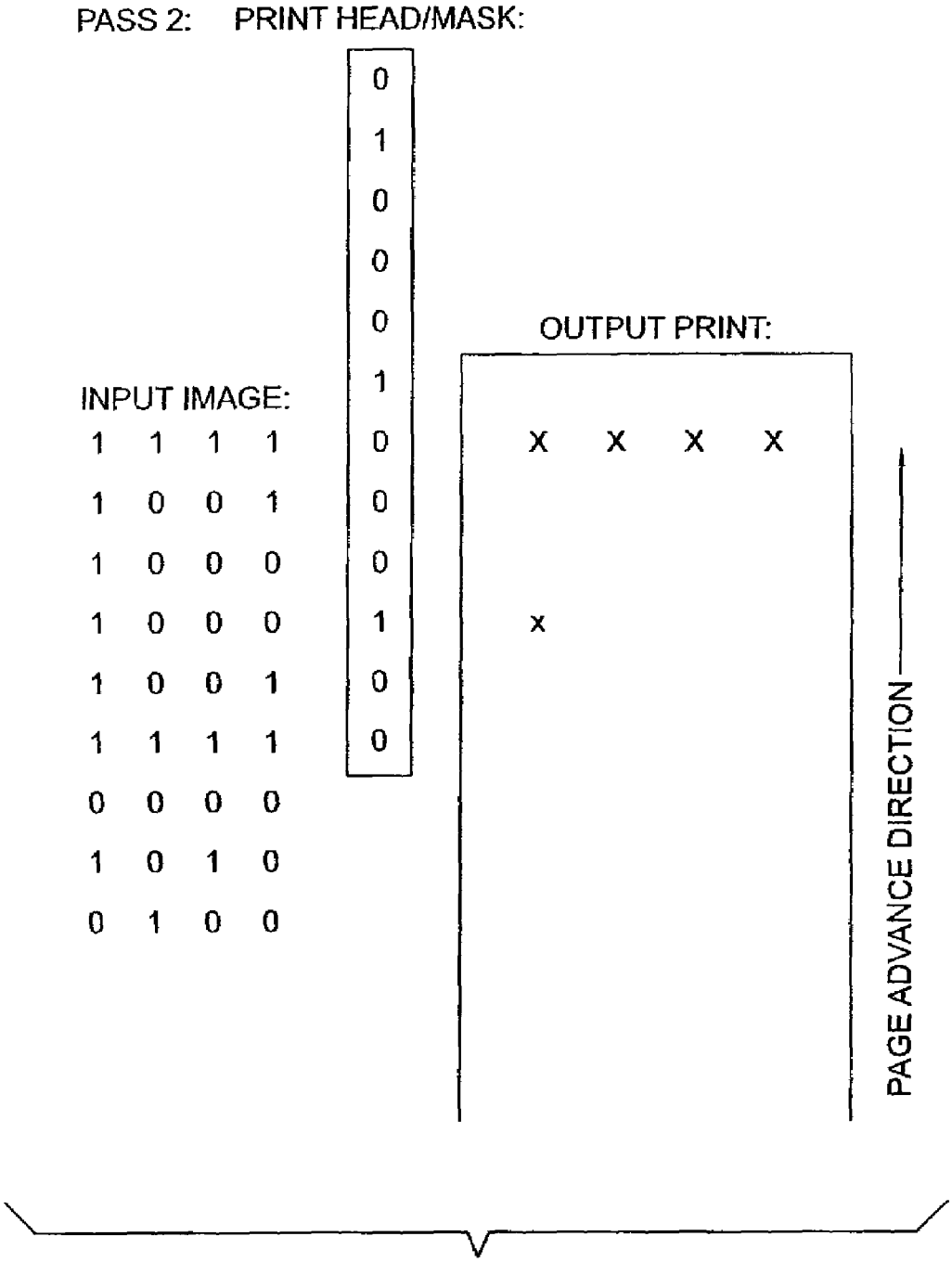
Figure 5C:
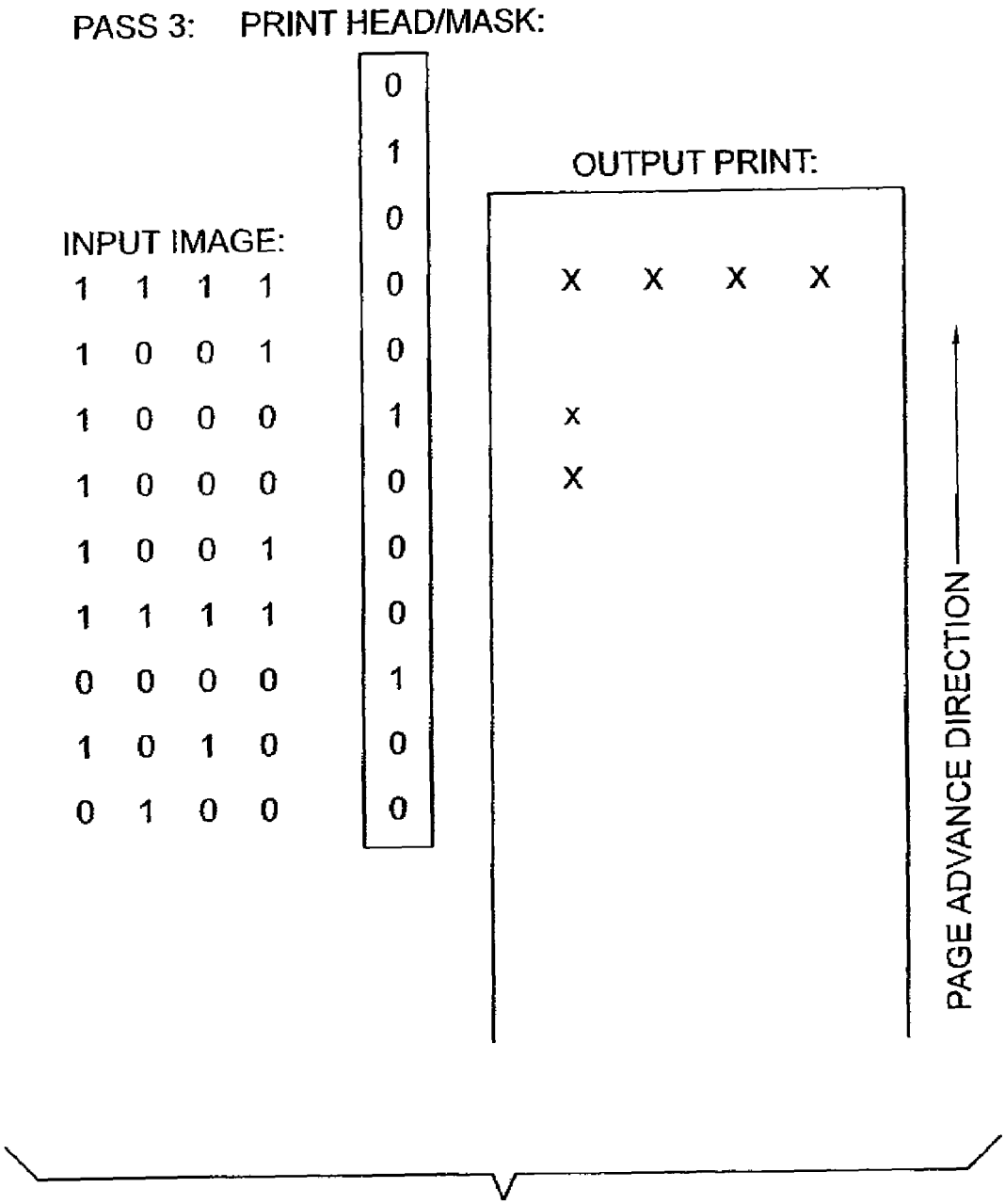

The mask is tiled across the width of the image. For example, if a print mask had a width of 4, the first column of the image data would be applied against the first column of the print mask. The second column of the image data would be applied against the second column of the print mask, and so on. The fifth column of the image would be applied against the first column of the print mask, as the mask is tiled. FIG. 4, discussed below, shows the same mask, with the mask data shown in the printhead, rather than the mask layout identifiers.

FIG. 4 shows that on any one line of the image, there is only one pass that may lay down a drop in a particular pixel location. Note that this mask is a 4-pass mask that will print at most one drop per pixel. FIG. 5*a* through 5*f* shows a sequence of diagrams illustrates the sequence of printing using the same mask from the previous example. In this example sequence, the image to be printed is 4 pixels wide by 9 pixels high. An 'x' in the output print denotes a printed drop on that pass. An 'X' denotes a drop from a previous pass.

In order to handle printing of multiple drops per pixel location, the mask may contain more than one plane. The number of drops to be printed at each location is used to determine which plane of the mask to use for that location. The first plane of the mask is used to print at locations where there will be one drop. The second plane of the mask is used to print at locations where there will be two drops, and so on up to the number of planes in the mask. When the input image data is zero, no drop ejection is called for, and there is nothing to look up in the print mask. A mask may contain up to N planes, where N is the number of print passes to be performed on the image, and N is at least 1. Plane P of the mask, where 1<=P<=N, has complementary nozzle data that adds up to the value P.

The following diagram shows the contents of a print mask following the above rules. In this example H=12, N=4, SH=3, C=1, P=4. There are 4 planes of data in the print mask. Adding the complementary nozzles of each plane together, the total for each complementary nozzle set is equal to the plane number.

| Plane 1 | Plane 2 | Plane 3 | Plane 4 |
|---|---|---|---|
| 0 | 0 | 1 | 1 |
| 1 | 1 | 1 | 1 |
| 0 | 0 | 0 | 1 |
| 0 | 1 | 0 | 1 |
| 0 | 0 | 1 | 1 |
| 1 | 1 | 1 | 1 |
| 0 | 0 | 1 | 1 |
| 0 | 1 | 0 | 1 |
| 0 | 0 | 1 | 1 |
| 1 | 1 | 1 | 1 |
| 0 | 0 | 1 | 1 |
| 0 | 1 | 1 | 1 |

(001) The use of this type of multi-plane print mask follows the same sequence of printing as does the previous examples, with one change: The value of the input pixel at each location will determine which plane of the print mask is used for determining whether to output a drop at that location. The use of a multi-planed print mask is described more fully in U.S. patent application Ser. No. 11/362,346 entitled "MULTI-LEVEL PRINTING MASKING METHOD", filed on Feb. 24, 2006 by Eastman Kodak, in the names of Steven A. Billow, Douglas W. Couwenhoven, Richard C. Reem, and Kevin E. Spaulding, the contents of which are fully incorporated by reference as if set forth herein.

The invention may be best understood from the embodiments described below wherein the choice of a printing nozzle is controlled by the print mask 22. The size of the mask 22 is increased or decreased as a transition position between printing regions is passed until the desired mask size for the new printing region is reached. This is done one mask section at a time, as the printhead advances past the transition point to the new mode. In the context of passing a transition position we will sometimes refer herein to the printhead, the mask or the paper passing the transition position. We mean these to be essentially equivalent. In terms of the paper being held differently near the leading edge, within the middle region, or near the trailing edge, in a physical sense it is the paper that actually passes a transition position.

A transition position may be defined, for example, when the leading edge of the paper is a given distance (one quarter inch, for example) past the first nozzles it encounters. A second transition region may be defined, for example when the leading edge of the paper is a second given distance (one half inch, for example) past the first nozzles it encounters. Because in our figures it is simplest to represent the printhead as moving, we will also refer to the printhead as passing a transition position. Finally, since the mask moves with the printhead, we will also refer to the mask as passing a transition position. The nozzles corresponding to the mask size increase or decrease must include the set of complementary nozzles from each section. As the mask size is reduced, for example, the mask contents are shifted to one end of the printhead. This remapping of the mask within the head allows the page advance distance to be changed to the new page advance distance only once as a transition position is passed. By subsampling the main body print mask for use at the edge areas rather than using a separate print mask for each region, memory and storage usage is reduced. Also, since the entire image is printed with the same dither pattern and duty cycle profile, a more uniform appearance is maintained in the print. This print mode change process will work on print masks with any number of passes, as long as the page advance distance is constant for the entire base mask and may be applied multiple times at one or both edges of a print, gradually increasing or decreasing the size of the print mask as needed.

Additionally the print mask height can be adjusted to help compensate for failed nozzles. By changing the print mask height slightly, the pattern of complementary nozzles can be changed. This can be used to work around cases where multiple complementary nozzles have failed and there are not enough nozzles in a set to print the required number of drops.

Figure 6:
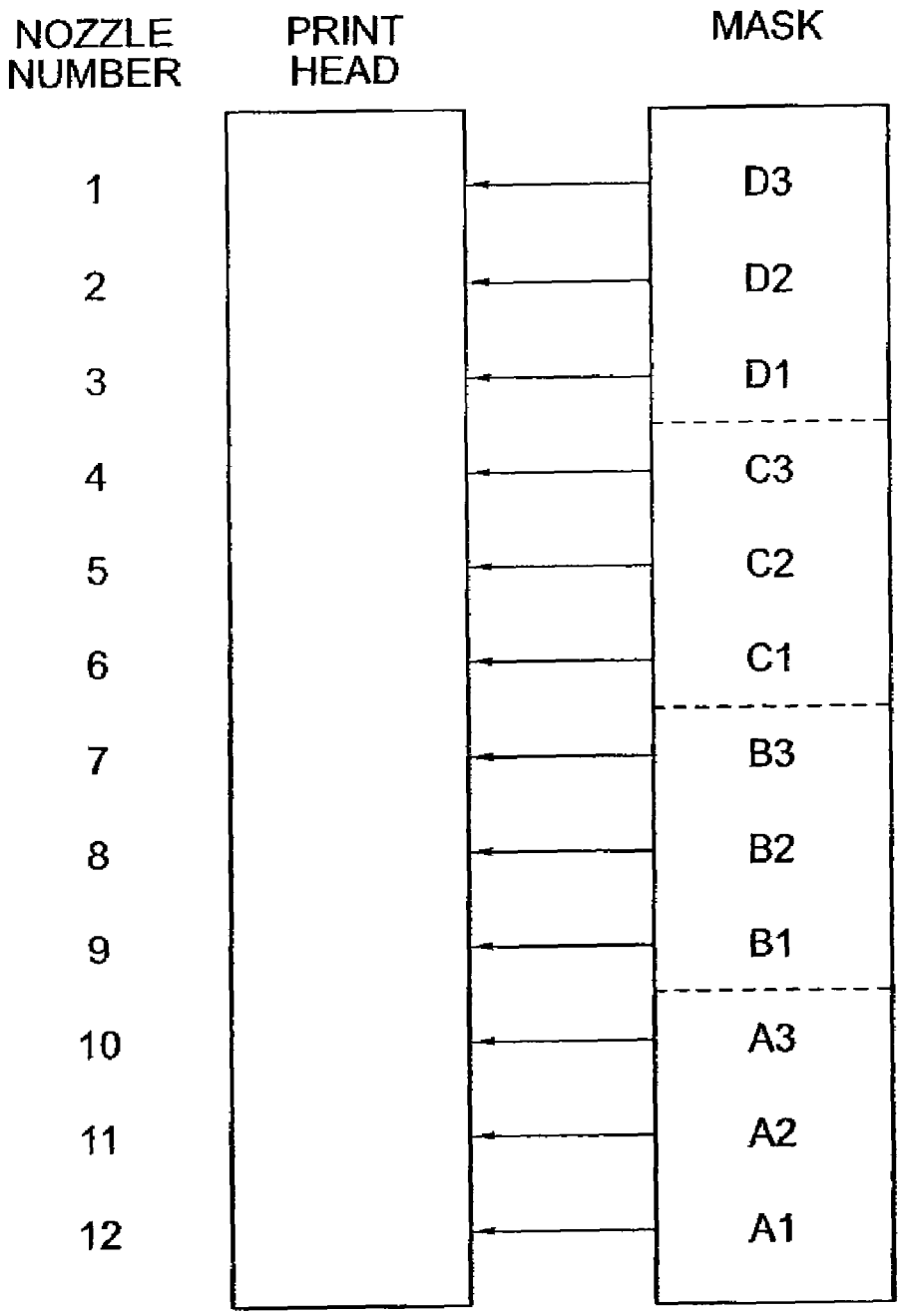
FIG. 6 illustrates a 4-pass print mask as it is mapped to the print head for normal printing.
Figure 7:
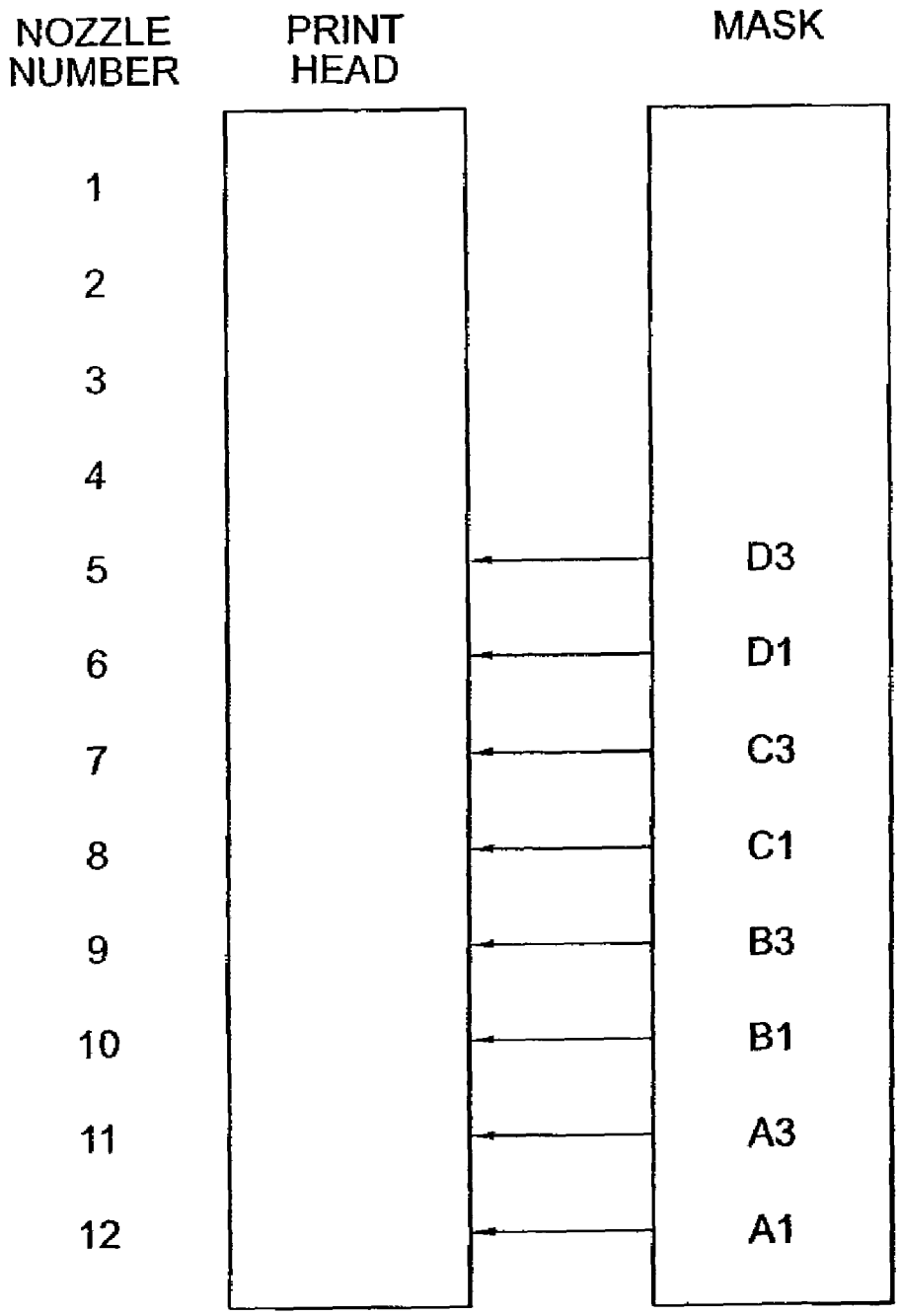
FIG. 7 illustrates the exemplary mask of FIG. 6 including mapping of a subsampled version of the same print mask to the printhead for printing at the start of a page.

FIG. 6 shows a 4-pass print mask as it is mapped to the printhead for normal printing. In this example, the mask height is 12, so the page advance distance for normal printing would be 3. FIG. 7 shows the mapping of a subsampled version of the same print mask to the printhead for printing at the start of a page. Note that in the subsampling, one set of mask positions, corresponding to complementary nozzles A2, B2, C2 and D2, has been removed from the mask. The remaining mask data has been shifted to the lower end of the printhead (nozzles 5 through 12). Thus nozzles 1 through 4 will not be used at all near the leading edge of the paper. In this example, the mask height has been reduced to 8, so the page advance distance for this new mode would be 2.

When the mask is prepared to change in accordance with this invention one option is to create subsampled mask by removing or adding a group of lines in the middle of each mask section and thus deactivating or activating the associated nozzles, or by removing or adding every Nth line from each mask section and thus deactivating or activating the associated nozzles as will be discussed below in more detail. There are other patterns that one skilled in the art would understand would also result in an appropriate change as long as they were done one section at a time and involved sets of complementary nozzles. The sets of nozzles that are deactivated must be the complementary nozzles from each section.

The number of mode changes necessary is now less than in previous methods and this results in less page advance distances. In previous methods, the page advance distance would need to be changed up and down on each swath in the transition zone. For the present invention the page advance changes directly from the old to the new advance, reducing the number of page advance distances and also eliminating all the very short advances. Thus the present invention more adeptly spreads the change in the amount of the printhead used over multiple passes, which helps reduce the paper advance errors as well as density and grid breakup effects normally encountered when suddenly changing the head height. Finally only one source print mask is needed for the entire print, reducing the NVRAM size needed for storing print masks. Note that if too many complementary nozzles are inactive due to failed nozzle correction for any print mode, the height of the mask used for that mode could be changed slightly so that the complementary nozzle sets change, allowing for the failed nozzle correction to succeed.

Figure 8:
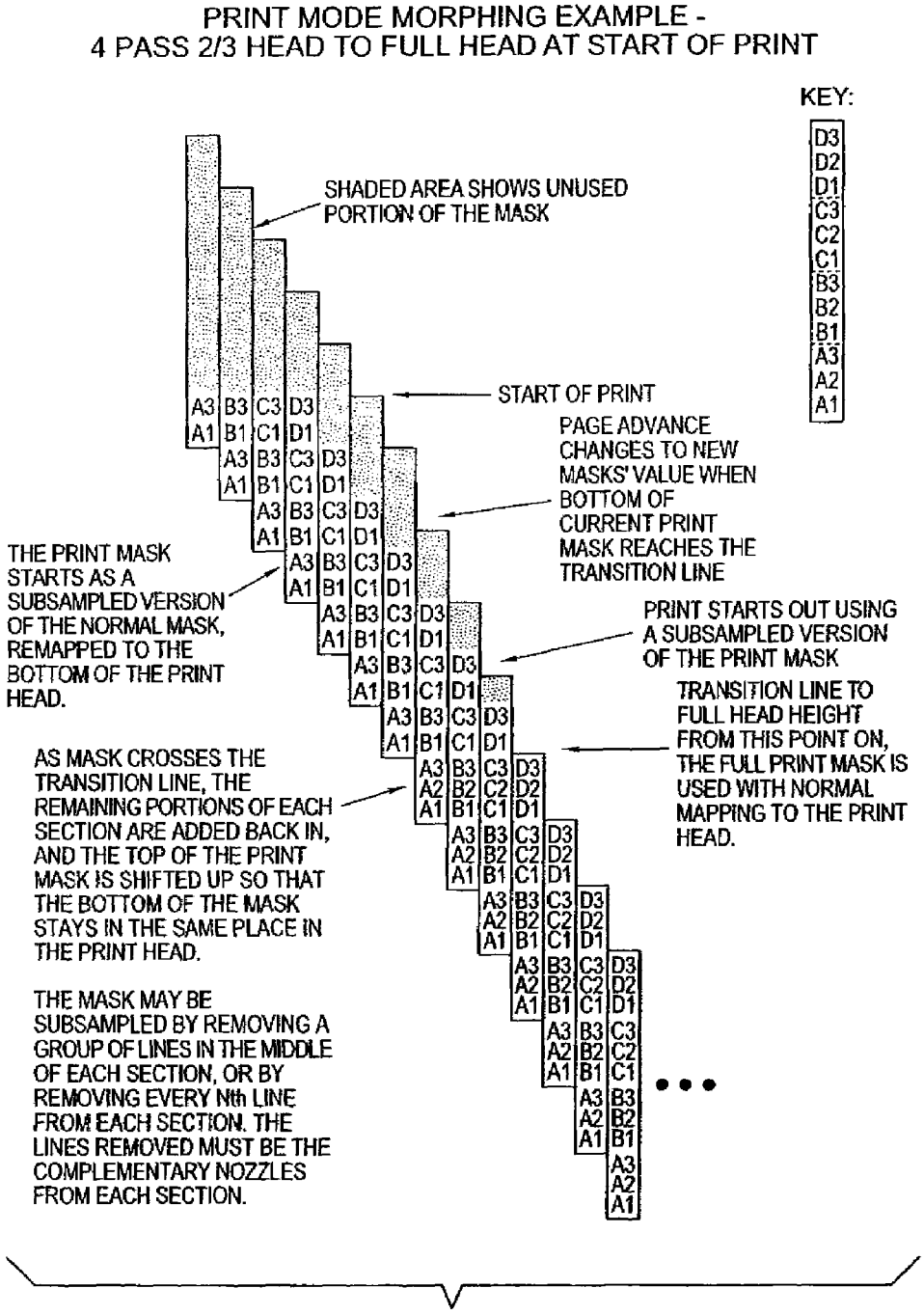
FIG. 8 shows a first embodiment.
Figure 9:
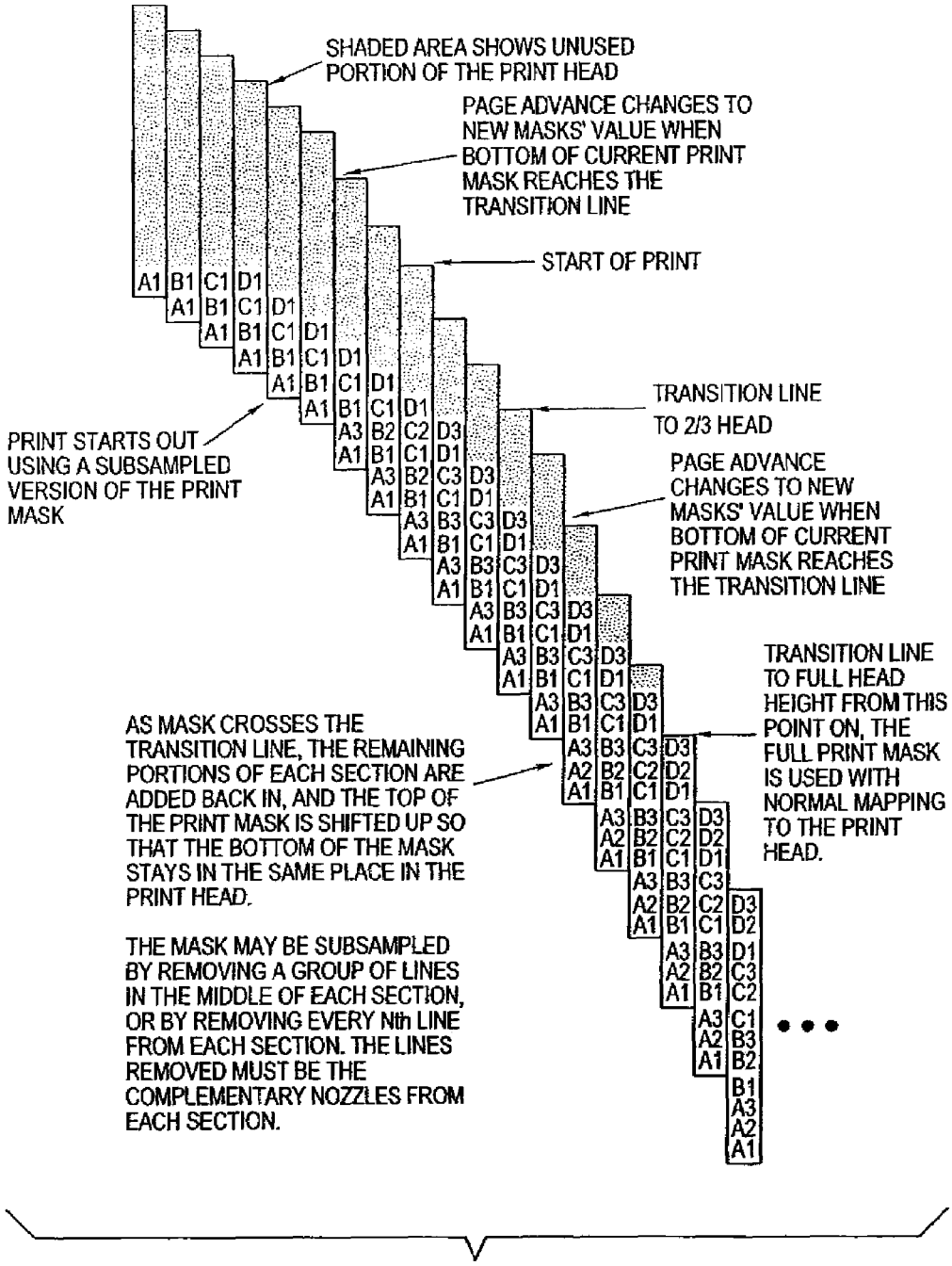
FIG. 9 shows a second embodiment.
Figure 10:
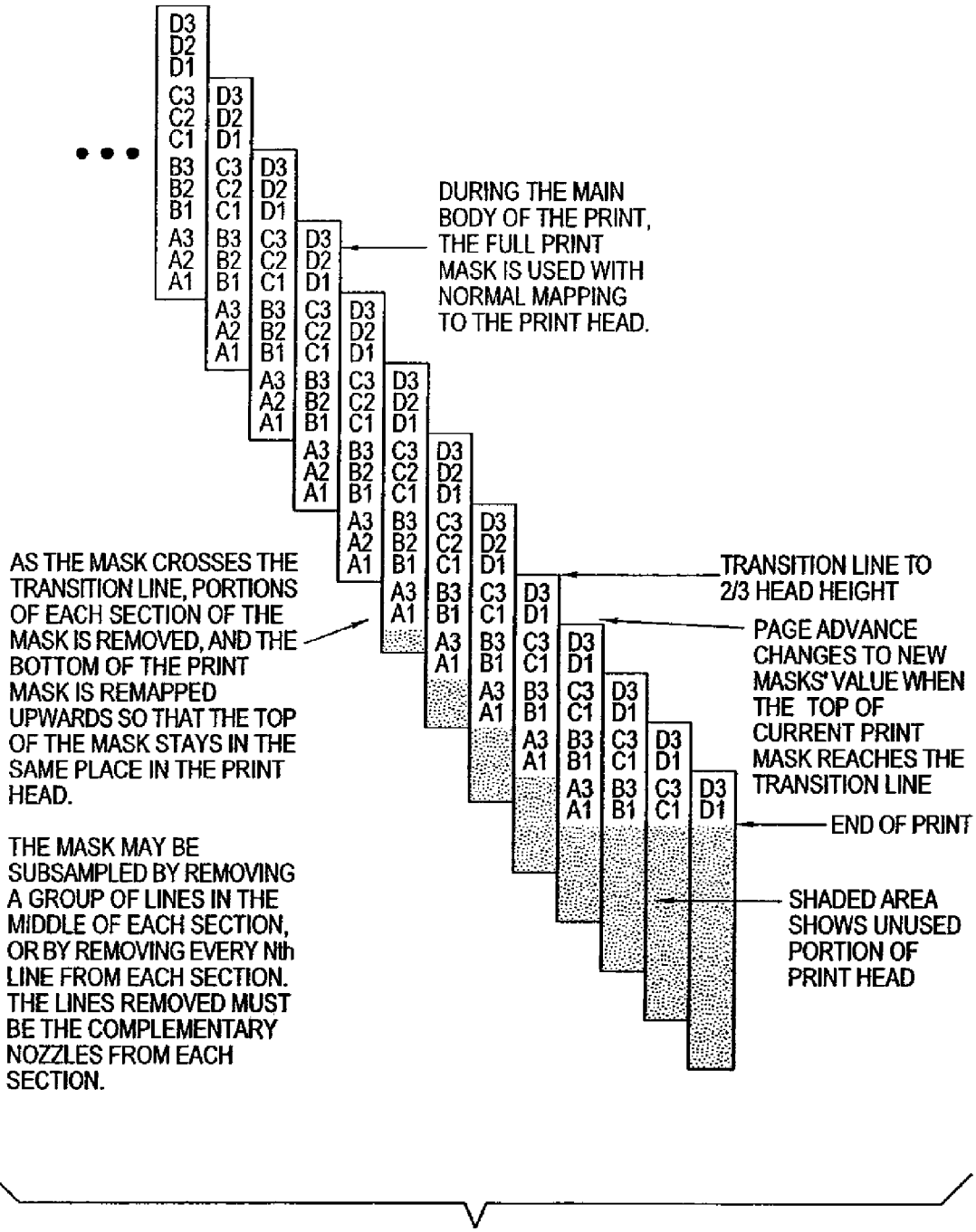
FIG. 10 shows a third embodiment.

FIGS. 8, 9 and 10 show three embodiments of this invention.

FIG. 8 shows a print mode change example for a 4 Pass ⅔ head to full head at the beginning (i.e. near the leading edge) of a page print. The shaded area shows unused portion of the printhead 12. The print mask starts using a subsampled version of the normal mask as described above, remapped to the bottom of the printhead. The page advance changes to a new mask when the bottom of the current print mask 22 reaches the transition position. The print starts out using a subsampled version of the print mask. As paper crosses the transition position, the remaining portions of each section are added back in or activated, and the top of the print mask is shifted up and the bottom of the mask stays in the same place in the printhead. The mask may be subsampled by deactivating one or more sets of mask positions corresponding to complementary nozzles in the middle of each section, or by deactivating every Nth set of mask positions corresponding to complementary nozzles from each section. After the activated nozzles in the printhead pass the transition position the mask changes to a full head height from that point onward. When the full print mask is used it is used with normal mapping to the printhead.

FIG. 9 shows a print mode change example—4 pass ⅓ to ⅔ head to full head at start of print, i.e. near the leading edge. The shaded area shows unused portion of the printhead 12. The print mask starts using a subsampled version of the normal mask, as described above, remapped to the bottom of the print head. Two transition positions are defined near the leading edge in this example. The page advance distance changes to a new advance distance when the bottom of current print mask 22 reaches the first transition position. As the mask crosses the transition position, the remaining portions of each section are added back in, and the top of the print mask is shifted up and the bottom of the print mask stays in the same place in the printhead. The mask may be subsampled by deactivating one or more sets of mask positions corresponding to complementary nozzles in the middle of each section, or by deactivating every Nth set of mask positions corresponding to complementary nozzles from each section. After the printhead passes the transition position the mask changes to a ⅔$^{rd}$ head height from that point until the mask passes the second transition position and then the full head height is restored and the full print mask used with normal mapping to the print head.

FIG. 10 shows a print mode change example—4 pass full to ⅔ head at end of print, i.e. near the trailing edge. The shaded area shows unused portion of the printhead 12. During the main body of the print in the middle region, the full print mask and page advance distance are used with normal mapping to the printhead. As the mask crosses the transition position, portions of each section of the mask are deactivated, and the bottom of the print mask is shifted up so that the top of the mask stays in the same place in the printhead. The mask may be subsampled by deactivating one or more sets of mask positions corresponding to complementary nozzles in the middle of each section, or by removing every Nth set of mask positions corresponding to complementary nozzles from each section. The mask is subsampled and remapped to ⅔ of the head height as the mask passes the transition position, and the page advance distance is changed correspondingly to the subsampled mask. The trailing edge of the print is thus printed using a subsampled version of the print mask.

In all embodiments of this invention it is important that the following rules be followed in order to make an effective transition to the new mode. These rules are not exhaustive and are only meant to be a guide:

1) The transition lines between modes are to be placed so that they fall at the end of the mask on the previous mode.

2) Near the leading edge of the print, the bottom of the head (closest to the main rail) is used, and near the trailing edge of the print the top of the head (closest to the star wheel rollers) is used. This will reduce the effect of paper curl on pen/paper spacing when paper is only held by one roller. The portion of the head to be used determines the direction to shift the print mask contents when remapping the subsampled mask onto the print head.

3) When transitioning to a longer mask at the start of the print (i.e. from the leading edge to the middle region), the page advance is changed when the bottom of the current mask reaches the transition line. As the mask crosses the transition line, the remaining portions of each section are added back in, and the data at the top of the print mask is shifted up (i.e. in the opposite direction from the page advance direction) and the bottom of the mask stays in the same place in the printhead.

4) When transitioning to a shorter mask at the end of the print (i.e. from the middle region to the trailing edge), the page advance is changed when the top of the current mask reaches the transition line. As the mask crosses the transition line, portions of each section of the mask are deactivated, and the data at the bottom of the print mask is shifted up (i.e. in the same direction as the page advance direction) and the top of the mask stays in the same place in the print head.

The invention has been described in detail with particular reference to certain preferred embodiments thereof, but it will be understood that variations and modifications can be effected within the spirit and scope of the invention.

The invention claimed is:

1. A print mask control device for selection of dot forming elements in a print head when the printhead approaches a transition position in a paper path comprising:

a. a controller, responsive to image data representing the image and paper location, the controller configured to alter a print mask table that stores mask data values that determine whether or not each dot forming element is actuated at a respective pixel location on the reference raster during a respective printing pass such that the controller further activates or deactivates mask data corresponding to every Nth set of complementary dot forming elements; and b. an altered mask such that mask data corresponding to at least one set of complementary dot forming elements is activated or deactivated in response to paper location, and the mask data is shifted along a paper movement axis as the print head passes the transition position.

2. A method for altering a print mask for a printhead supporting the plurality of dot forming elements arranged in sections by complementary sets and a paper path with a transition position when printing in a first print mode, the method comprising the steps of:

a. switching to a second print mode by changing the size of the print mask as the printhead advances past the transition position near the leading edge of the paper by changing a mask position corresponding to a set of complementary dot forming elements including increasing the size of the print mask and shifting the mask data in the same direction as the page advance direction such that the increasing step further comprises making every Nth set of mask data, corresponding to the complementary dot forming elements from each mask section, activated; and b. shifting each section of mask data along a paper movement axis by the number of changed mask positions such that the number of dot forming elements is changed.

3. The method according to claim 2, the printhead further comprising an inkjet printhead.

4. The method according to claim 2, further comprising switching to a third print mode after the printhead has moved past a second transition position.

5. The method according to claim 2, the shifting step further comprising increasing the size of the print mask and shifting the mask data in the same direction as the page advance direction.

6. The method according to claim 2, further comprising advancing the paper at a first distance before the printhead advances past the transition position and switching to a second paper advance distance after the print head has moved past the transition position.

7. The method according to claim 6 wherein advancing the paper at the first distance before the printhead advances past the transition position further comprises changing the page advance distance so that the resultant mask, which has had sections added or removed from the base mask, falls on a proper place relative to a paper edge since the height of the mask and its position in the head has changed since the previous pass.

8. The method according to claim 5, wherein the increasing step for increasing the size of the mask is performed sequentially, one mask section at a time.

9. The method according to claim 5, the increasing step further comprising making a set of mask data, corresponding to complementary dot forming elements in the middle of the mask section, activated.

10. The method according to claim 2, wherein dot forming element operational malfunction is considered in order to determine which dot forming elements to activate.

11. The print mask control device according to claim 1, wherein: combinations of a transition point and a previous and anticipated mode is a decision value; and the decision values increase the size of the print mask and mask data is shifted in the same direction as the page advance direction.

12. The print mask control device according to claim 1, wherein paper is advanced at a first distance prior to passing the transition position switching to a second paper advance distance after the printhead has moved past the transition position.

13. The print mask control device according to claim 1, wherein the mask data corresponding to the set of complementary sets of dot forming elements shift sequentially, one mask section at a time.

14. The print mask control device according to claim 1, further comprises a control to activate or deactivate mask data corresponding to a set of complementary dot forming elements in the middle of the mask section.

15. The print mask control device according to claim 1, wherein the controller controls a change from a first advance distance to a second advance distance at the transition position so that advancing the paper at the first distance before the printhead advances past the transition position further comprises changing the page advance distance so that the altered mask, which has had sections added or removed from the mask, falls on a proper place relative to a paper edge since the height of the altered mask and its position in the head has changed since the previous pass.

* * * * *